US006508231B2

(12) United States Patent
Boecking

(10) Patent No.: US 6,508,231 B2
(45) Date of Patent: Jan. 21, 2003

(54) COMMON-RAIL-INTEGRATED INJECTOR FOR INJECTION SYSTEMS

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/917,152

(22) Filed: Jul. 30, 2001

(65) Prior Publication Data

US 2002/0056767 A1 May 16, 2002

(30) Foreign Application Priority Data

Jul. 28, 2000 (DE) ..... 100 36 868

(51) Int. Cl.[7] ..... F02M 41/00

(52) U.S. Cl. ..... 123/456; 123/458; 251/44; 251/30.02

(58) Field of Search ..... 123/456, 458, 123/500, 501, 467; 251/44, 30.02

(56) References Cited

U.S. PATENT DOCUMENTS

| | | | | |
|---|---|---|---|---|
| 4,777,921 A | * | 10/1988 | Miyaki et al. | 123/456 |
| 5,213,084 A | * | 5/1993 | Linder et al. | 123/456 |
| 5,456,233 A | * | 10/1995 | Felhofer | 123/447 |
| 5,816,220 A | * | 10/1998 | Stumpp et al. | 123/435 |
| 6,330,876 B1 | * | 12/2001 | Spinnler et al. | 123/456 |

* cited by examiner

*Primary Examiner*—Carl S. Miller
(74) *Attorney, Agent, or Firm*—Ronald E. Greigg

(57) ABSTRACT

The invention relates to an injector for delivering fuel to a combustion chamber of direct-injection internal combustion engines, having a high-pressure connection chamber. A control part closes or opens a valve chamber from which a nozzle inlet line branches off to an injection nozzle, which protrudes into the combustion chamber of the engine. A control chamber is integrated with the high-pressure connection chamber, and with the control chamber, the control part can be actuated.

14 Claims, 1 Drawing Sheet

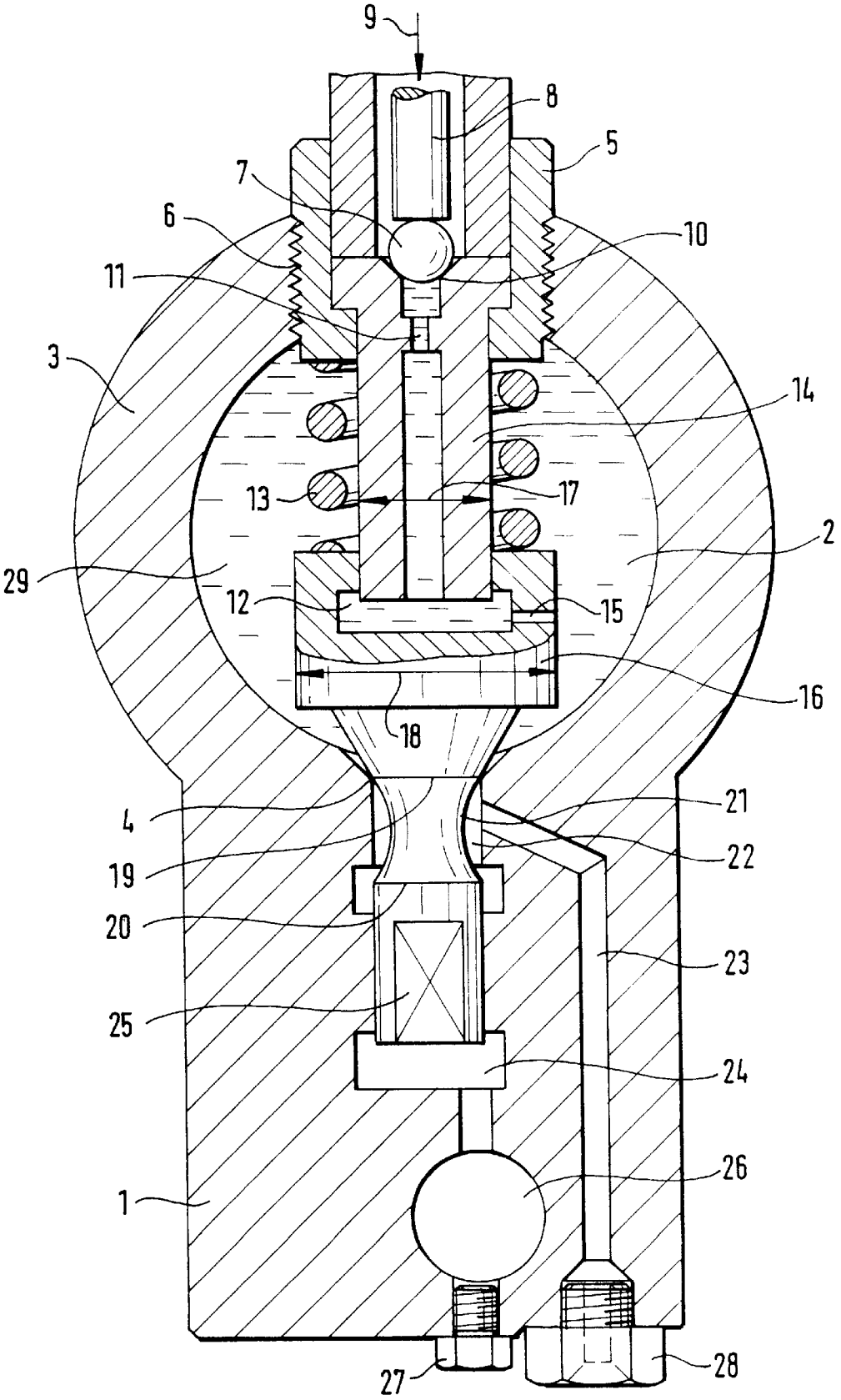
9
8
5
7
6
10
11
3
14
13
17
2
29
12
15
16
18
4
21
19
22
20
23
25
24
26
1
27
28

COMMON-RAIL-INTEGRATED INJECTOR FOR INJECTION SYSTEMS

BACKGROUND OF THE INVENTION

1. Field of the Invention

The invention relates to an injector of an injection system, having a high-pressure connection chamber (common rail) and an injection nozzle protruding into the combustion chamber of an internal combustion engine. It has proved advantageous that the pressure prevailing in the high-pressure connection chamber is not applied permanently to the injection nozzle of an injection system but instead is controllable via a separate control part. There is a need to keep the control volume of the fuel, which is at very high pressure, as small as possible.

2. Prior Art

From German Patent Disclosure DE 198 35 494 A1, a unit fuel injector with which fuel can be injected into a combustion chamber of a direct-injection internal combustion engine is known. The unit fuel injector includes a pump unit for building up an injection pressure for injecting the fuel into the combustion chamber via an injection nozzle. A control unit is provided, which includes a control part. A valve actuating unit is also provided, which serves to control the pressure buildup. To furnish a unit fuel injector of simple design and small size which in particular has a short response time, the valve actuating unit is embodied as a piezoelectric actuator. In the configuration of the prior art, the valve actuating unit is mounted laterally on the injector and thus requires additional installation space at the cylinder head of an internal combustion engine, space that is extremely scarce at that location.

SUMMARY OF THE INVENTION

With the version according to the invention, there is the advantage on the one hand of a substantially more compact structure. A separate supply line from the high-pressure connection chamber (common rail) to the control part can be dispensed with, since the control part is now disposed in a space-saving way in the interior of the high-pressure connection chamber. Pressure pulsations in the line system are not transmitted to the injection nozzle which performs the injection, and which protrudes into the combustion chamber of the engine and meters the injection quantity. Postinjections can thus be effectively counteracted.

On the other hand, with the version proposed by the invention it can be attained that the control volume remains small. By means of an inlet throttle discharging from the high-pressure connection chamber into the control chamber, a partial volume of fuel that is sufficient to trigger the control part is always present, so as to assure triggering of the control part that partially penetrates the high-pressure connection chamber. The control part is acted upon by a sealing spring, which in the closed state of the control part assures that the control part is pressed against a seat face of the housing of the high-pressure connection chamber, thus assuring effective sealing off of the high-pressure connection chamber from the valve chamber.

The control chamber is provided in the portion of the control part that is located in the hollow space of the high-pressure connection chamber. The inlet throttle to the control chamber likewise discharges into this hollow space. On the outlet end of the force-balanced valve control part in the hollow chamber of the high-pressure connection chamber, an outlet throttle is provided, which discharges into a seat face; the seat face is closed by a sealing element, which for example is embodied in the form of a ball. The control valve on the outlet side can be actuated via an electromagnet, or a piezoelectric actuator, to relieve the control chamber in the control part.

Below the valve chamber in the valve housing, a leaking oil chamber is provided, from which a leaking oil rail branches off. The leaking oil rail is closed via one or more releasable closures and can be evacuated by way of them. Besides an individually performable evacuation at the various closures, it is also possible for the leaking oil rail to be designed such that it discharges into the fuel tank.

By means of the seat faces for the control part that are embodied on the housing of the injector and by means of the control edge embodied on the control part, the valve is closed on the leaking oil side, in the open state. The high-pressure connection chamber is thus effectively secured against direct communication with the leaking oil chamber.

BRIEF DESCRIPTION OF THE DRAWING

The invention will be explained in further detail below in conjunction with the sole drawing FIGURE which is a cross section through the high-pressure connection chamber, with the control part integrated with it, which control part is actuatable via an externally actuatable actuator.

DESCRIPTION OF THE PREFERRED EMBODIMENTS

The drawing shows an essentially force-balanced injector, which includes a high-pressure connection chamber that is penetrated by a portion of a control part.

The high-pressure connection chamber 2 is surrounded by a housing 1, which receives a fuel supply 29 that is under very high pressure. Through an inlet throttle 15 that penetrates the wall of the control part 16, a partial volume of the fuel supply 29 flows into the control chamber 12. The control chamber is embodied in a sleeve, which extends coaxially to the line of symmetry of the control part 16.

A control connection 5 is screwed into the wall 3 of the high-pressure connection chamber 2, or secured in some other way, and the control connection contains a relief valve for the control chamber 12. The control chamber 12, extending essentially coaxially through a sleeve part, discharges into control connection 5 at a seat face 10. The seat face 10, in the exemplary embodiment illustrated is closed by a ball-shaped sealing element 7. The ball-shaped sealing element 7 can be pressure-relieved, for instance and a pressure bolt 8 and an electromagnet or a piezoelectric actuator or some other valve actuating unit. Reference numeral 9 indicates the effective actuator direction, in which the actuator—whether it is an electromagnet or a piezoelectric actuator—exerts pressure via the pressure bolt 8 on the sealing element 7, which closes off the sealing face 10 from the control chamber 12.

Inside the hollow space defined by the wall 3 of the high-pressure connection chamber 2, a fuel supply 29 which is at extremely high pressure is received. The high-pressure connection chamber 2 in turn is embodied as a rail and is partly penetrated by the control part 16 of the control valve. The compression spring acting as a sealing spring 13 inside the hollow space of the high-pressure connection chamber 2 is braced against a face end of the control connection 5 and presses the part of the control part that contains the control chamber 12 and the inlet throttle 15 against a seat face 4 in the housing 1. The sleeve defining the control chamber 12 is embodied with a first diameter 17 and acts as a guide for the sealing spring 13, to prevent it from kinking. The part of the control part 16 that contains the control chamber and the inlet throttle 15 is embodied with a second diameter 18, while in the region of its sealing seat of the seat face 4, the control part 16 has a seat diameter 19. The seat diameter 19 is embodied above a constriction point 21 embodied on the control part 16 and is selected such that at the effective force of the sealing spring 13, it seals off the interior of the high-pressure connection chamber 2 from the valve chamber 22 that surrounds the control part 16.

In the lower part of the housing 1 of the injector, the control part 16, which performs the fuel metering into the nozzle inlet 23, is embodied with a substantially smaller diameter. Beginning at the seat diameter 19 of the control part 16 that is operative at the seat face 4 of the housing, the control part is given a curved course in the context of a constriction 21, which comes to an end at a control edge 20 of the control part 16. The control edge 20 of the control part 16 is adjoined by a region of the control part 16 in which faces 25 laterally opposite one another are embodied. These faces enable an outflow of excess fuel from an annular space, surrounding the control edge 20 of the control part 16, into a leaking oil chamber 24. From the leaking oil chamber 24, the fuel volume can flow into a leaking oil rail 26, which is embodied in the lower region of the housing 1 of the injector. The leaking oil line 26 can extend parallel to the high-pressure connection chamber 2, which is located in the upper region of the housing 1 of the injector, and can discharge into the fuel tank of the motor vehicle and in this way prevent a loss of leaking oil.

On the other hand, individual closures 27 that enable an evacuation of the leaking oil rail 26 can also be provided on the housing 1. In the exemplary embodiment of the subject of the invention, the leaking oil line 26 can be evacuated by means of a closure 27 in the form of a leaking oil screw, which is accessible from the underside of the housing 1.

A high-pressure line 23, which assures the fuel supply to the injection nozzle, branches off from the valve chamber 22 inside the housing 1 of the injector. The inlet to the nozzle 23 is embodied inside the housing 1 of the injector as a bore, which bore comes to an end in a nozzle connection piece 28 on the housing 1 of the injector. A supply line to the injection nozzle, which nozzle protrudes into the interior of an injection chamber to be supplied with fuel, can be secured to the nozzle connection piece 28.

The mode of operation of the injector proposed according to the invention as shown in the drawing for injecting fuel that is under extremely high pressure into a combustion chamber of an internal combustion engine, is as follows:

Upon actuation of the valve actuating unit, acting on the sealing element 7 via the pressure bolt 8, this unit being in the form of an electromagnet or piezoelectric actuator, the pressure bolt 8 is moved counter to the effective actuator direction 9, as a result of which the seat face 10 at the sealing element 7 is uncovered, and fuel under high pressure present in the control chamber 12 emerges on the outlet side via the outlet throttle 11 into the leaking oil region. This causes a compression of the sealing spring 13, since the part of the control part 16 embodied with the second diameter 18 compresses the sealing spring 13 and moves vertically upward. In this motion, this face 4 on the underside of the high-pressure connection chamber 2 is uncovered, and fuel at extremely high pressure can pass through the opening uncovered between the seat face 4 of the housing 1 and the seat diameter 19 of the slide (control part) and enters the valve chamber 22, defined by a constriction point 21 at the control part 16 and the housing. Upon a vertical motion of the control part 16 in the direction of the control connection 5, the control edge 20 of the control part 16, which forms the lower edge of the constriction 21, covers one edge of the housing 1 of the injector and thus, upon opening of the high-pressure supply line, effectively seals off the hollow leaking oil chamber 24 on the outlet side from the fuel supply 29 that is at high pressure. It is thus assured that upon opening of the control part 16 at the seat face 4, no direct communication can occur from the high-pressure connection chamber 2 to the leaking oil chamber 24 and to the line system downstream thereof.

In the opened state of the seat face 4 on the housing 1 of the high-pressure connection chamber 2, the fuel supply 29 which is at high pressure flows into the valve chamber 22 and from there through the inlet line 23 to the injection nozzle. The injection nozzle is not shown in FIG. 1; the nozzle inlet line can be connected to the housing 1 of the injector at the nozzle connection piece 28.

If once injection has occurred, the electromagnet or piezoelectric actuator, not shown in detail here and acting as a valve actuating element for the sealing element 7, is actuated in the effective actuator direction 9, the seat face 10 above the outlet throttle 11 of the control chamber 12 is closed. By the action of the sealing spring 13 that penetrates the high-pressure connection chamber 2, the control element 16, embodied with the second diameter 18, is pressed with its seat diameter 19 into the seat face 4 of the wall 3 of the high-pressure connection chamber 2 and closes off the valve chamber 22 from a replenishing flow of fuel 29 at high pressure from the high-pressure connection chamber (common rail). In the downward motion of the control part 16, which is embodied essentially rotationally symmetrically to its axis of symmetry, the vertically downward-moving control edge 20 opens a hollow space annularly surrounding the control part 16, so that fuel still located in the valve chamber 22 can flow out into the leaking oil chamber 24 via the faces 25 embodied on the control part 16. From the leaking oil chamber, the oil flows on the outlet side into a leaking oil line 26, which can communicate with the fuel tank, for instance.

With the version proposed according to the invention, the fuel quantity provided in the control chamber 12 of the control part 16 can be kept quite small; in addition, the injector body proposed according to the invention is very small in size, since a supply line system from the high-pressure connection chamber 2 to the injector can be dispensed with, and the valve actuating unit can also be integrated directly into the wall 3 of the high-pressure connection chamber 2. The valve actuating unit can advantageously be accommodated as a screw-in element on the top side of the seat face 4 leading to the valve chamber 22. Instead of screwing the control connection 5 to the wall 3 of the high-pressure connection chamber 2, other connections can also be formed. Such a compact injector unit of an injector for a direct-injection internal combustion engine makes it possible for it to be integrated into a high-pressure connection chamber 2, extending in tubular form parallel to the cylinder head of an internal combustion engine, with the cylinders and thus the places on the cylinder head correspondingly adjacent to the injection chambers. Such a configuration of a high-pressure connection chamber 2 with an integrated injector makes a force balance of the injector possible, thus assuring a long service life of such a component. In addition, the control volume required to actuate the injector can be kept small, and as a result the efficiency of the injector proposed according to the invention is unimpaired.

The foregoing relates to preferred exemplary embodiment in the invention, it being understood that other variants and embodiments thereof are possible within the spirit and scope of the invention, the latter being defined by the appended claims.

I claim:

1. An injector for delivering fuel to a combustion chamber of direct-injection internal combustion engines, comprising a high-pressure connection chamber (2), a control part (16) which closes or opens a valve chamber (22), from which a nozzle inlet line (23) branches off to an injection nozzle that discharges into the combustion chamber of an internal combustion engine, and a control chamber (12) in said high-pressure connection chamber and communicating with it by way of which control chamber said control part (16) is actuatable.

2. The injector of claim 1, wherein said control chamber (12) is embodied in said control part (16) and is surrounded in said high-pressure connection chamber (2) by medium (29) that is at high pressure.

3. The injector of claim 1, wherein said control chamber (12) is subjected to a control volume via an inlet throttle (15).

4. The injector of claim 1, wherein said control chamber (12) can be relieved via a sealing element (7) actuatable by an externally actuatable actuator.

5. The injector of claim 4, wherein said the control chamber (12) further comprises an outlet throttle (11) on its outlet side.

6. The injector of claim 1, wherein said the high-pressure connection chamber (2) has a seat face (4), against which the seat diameter (19) of the control part (16) is pressed by a sealing spring (13).

7. The injector of claim 1, further comprising a sleeve (14) defining the control chamber (12), said sleeve (14) being integrated with a control connection (5) which is screwed to the housing (1) of the high-pressure connection chamber (2).

8. The injector of claim 7, wherein said sealing spring (13) is braced against the wall (3) of the high-pressure connection chamber (2).

9. The injector of claim 1, wherein, in said control part (16), a control edge (20) is embodied, which when the seat face (4) is opened seals off a valve chamber (22) at the high-pressure connection chamber (2) from a leaking oil chamber (24).

10. The injector of claim 1, wherein said nozzle inlet line (23) discharges into the valve chamber in the region located between the control edge (20) of the control part (16) and the seat face (4) of the housing (1).

11. The injector of claim 9, wherein said leaking oil chamber (24) communicates with a leaking oil rail (26) which can be sealed off with a releasable closure (27).

12. The injector of claim 4, wherein said externally actuatable actuator is an electromagnet.

13. The injector of claim 4, wherein said externally actuatable actuator is a piezoelectric actuator.

14. The injector of claim 4, wherein said externally actuatable actuator is a hydraulic-mechanical booster.

* * * * *